United States Patent [19]

Schäfer

[11] Patent Number: 4,609,493

[45] Date of Patent: Sep. 2, 1986

[54] SOLUTION AND METHOD FOR REMOVING INORGANIC AND ORGANIC DEPOSITS FROM CONTACT LENSES

[75] Inventor: Rolf Schäfer, Arisdorf, Switzerland

[73] Assignee: Alcon Laboratories, Inc., Fort Worth, Tex.

[21] Appl. No.: 687,275

[22] Filed: Dec. 28, 1984

[51] Int. Cl.[4] ..... C11D 1/06; C11D 3/33; C11D 3/386

[52] U.S. Cl. ..... 252/546; 252/174.12; 252/174.19; 252/174.21; 252/DIG. 12; 252/173; 252/DIG. 14

[58] Field of Search ..... 252/106, 174.21, 174.12, 252/DIG. 12, DIG. 14, 546, 174.19, 173; 514/839

[56] References Cited

U.S. PATENT DOCUMENTS

| | | | |
|---|---|---|---|
| 3,171,752 | 3/1965 | Rankin | 106/194 |
| 3,183,152 | 5/1965 | Szekely et al. | 167/59 |
| 3,240,709 | 3/1966 | Rankin | 252/106 |
| 3,311,577 | 3/1967 | Rankin | 260/17 |
| 3,539,520 | 11/1970 | Cantor et al. | 252/106 |
| 3,549,747 | 12/1970 | Krezanoski et al. | 424/78 |
| 3,639,576 | 2/1972 | Kaspar et al. | 424/78 |
| 3,755,561 | 8/1973 | Rankin | 424/78 |
| 3,767,788 | 10/1973 | Rankin | 424/78 |
| 3,856,919 | 12/1974 | Rankin | 424/78 |
| 3,882,036 | 5/1975 | Krezanoski et al. | 252/106 |
| 3,910,296 | 10/1975 | Karageozian et al. | 134/2 |
| 3,947,573 | 3/1976 | Rankin | 424/80 |
| 3,954,644 | 5/1976 | Krezanoski et al. | 252/106 |
| 4,096,870 | 6/1978 | Manfuso, Jr. | 134/28 |
| 4,127,423 | 11/1978 | Rankin | 134/30 |
| 4,152,283 | 5/1979 | Cordrey et al. | 252/99 |
| 4,285,738 | 8/1981 | Ogata | 134/26 |
| 4,311,618 | 1/1982 | Schafer-Burkhard | 252/542 |
| 4,356,100 | 10/1982 | Sherman | 252/100 |
| 4,407,791 | 10/1983 | Stark | 424/80 |
| 4,421,665 | 12/1983 | Lloyd et al. | 252/106 |
| 4,440,662 | 4/1984 | Tsuzuki et al. | 252/106 |
| 4,546,123 | 10/1985 | Schafer et al. | 523/106 |

FOREIGN PATENT DOCUMENTS

| | | |
|---|---|---|
| 0102118 | 7/1984 | European Pat. Off. . |
| 2854278 | 7/1980 | Fed. Rep. of Germany . |
| 3320340 | 12/1983 | Fed. Rep. of Germany . |
| 64303 | 5/1975 | Japan . |
| 125412 | 11/1978 | Japan . |
| 48712 | 3/1982 | Japan . |
| 2088581 | 6/1982 | United Kingdom . |

*Primary Examiner*—Prince E. Willis

*Attorney, Agent, or Firm*—James A. Arno; Gregg C. Brown

[57] ABSTRACT

A contact lens cleaning solution containing an enzyme having proteolytic activity and a surfactant, and optionally also a chelating agent and urea, and a method of cleaning contact lenses utilizing this solution are described. The solution and method effectively remove deposits of proteinaceous material, mucins, lipids and calcium located either on or beneath the surface of the lens.

6 Claims, No Drawings

SOLUTION AND METHOD FOR REMOVING INORGANIC AND ORGANIC DEPOSITS FROM CONTACT LENSES

BACKGROUND OF THE INVENTION

1. Field of the Invention

The present invention relates to the removal of organic and inorganic deposits from contact lenses, particularly soft contact lenses. More specifically, this invention relates to an aqueous solution for removing contact lens deposits made up of materials such as proteins, mucins, lipids and calcium, and to a method of cleaning contact lenses using this solution.

2. Description of Related Art

The solution and method of the present invention have been found to be particularly effective in removing unwanted deposits from soft contact lenses. Although this invention is not directly related to the manufacture of soft contact lenses, it should be noted that various materials and methods have been described in the prior art for use in the manufacture of these lenses. For example, U.S. Pat. Nos. 2,976,576 and 3,503,393 describe the use of hydrophilic or partially hydrophilic plastic materials commonly known as polymeric hydrogels for the manufacture of soft contact lenses. Specifically, these two patents relate to the manufacture of three dimensional polymeric hydrogels from poly(hydroxyethyl methacrylate) in aqueous media. These lenses have a cross-linked polymeric hydrogel structure and the appearance of an elastic, soft and transparent hydrogel. Various other materials may also be utilized for the manufacture of soft contact lenses, such as silicones or other optically suitable flexible polymers.

One of the problems connected with the use of soft contact lenses is the formation of unwanted deposits made up of organic and/or inorganic materials on the lenses when the lenses are worn on the human eye. This problem is especially troublesome when the lenses are worn for extended periods. These deposits normally comprise proteinaceous material, mucins, lipids and calcium. The deposits may be located both on the surface and below the surface of the lens, and may be strongly bound to the polymeric hydrogel. The presence of these deposits on the surface and beneath the surface of the lens can cause considerable discomfort and other symptomology to the wearer of the lens.

The above-described deposits can be quite difficult to remove from the lens due to the presence of deposits beneath the surface of the lens and the strong bond between the deposits and the polymeric hydrogel of the lens. The deposits present on the surface of the lens are more readily removed than are the deposits beneath the surface of the lens. U.S. Pat. No. 4,311,618 describes the use of chemical cleaners to remove cross-linked (denatured) proteins from lens surfaces. Various enzymatic preparations for removing contact lens surface deposits are also available. For example, U.S. Pat. No. 3,910,296 describes the use of proteolytic enzymes such as papain for the removal of proteinaceous material from the lens surface, and U.S. Pat. No. 4,096,870 describes the use of pancreatin for the removal of surface deposits consisting of proteinaceous material, mucins and lipids; pancreatin is an enzyme complex having proteolytic, lipolytic and amylolytic activity. However, deposits beneath the surface of the lens are generally difficult to remove by means of enzyme treatment alone. Furthermore, the sub-surface deposits are generally difficult to remove mechanically, such as by rubbing the lens. Thus, it is apparent based on the foregoing description that there is a need for a preparation which is capable of removing both surface and sub-surface deposits from soft contact lenses.

Applicant has discovered that sub-surface deposits can be effectively removed by means of chemical treatment. More specifically, applicant has discovered that these deposits can be effectively removed by soaking the lens in an aqueous solution containing a mixture which includes a surfactant, a calcium chelating agent and a source of hydrated protons, and optionally also urea; this discovery is described in detail in applicant's copending application entitled "Solution and Method for Removing Protein, Lipid, and Calcium Deposits from Contact Lenses" which application U.S. Ser. No. 687,274, was filed Dec. 28, 1984 now U.S. Pat. No. 4,599,195 concurrently with the present application. The lens cleaning solution of the present invention differs from the solution described in the above-cited copending application in that, inter alia, the former solution comprises a combination of chemical and enzymatic cleaning components.

SUMMARY OF THE INVENTION

A principal object of the present invention is the provision of a contact lens cleaning preparation that is capable of removing both surface and sub-surface deposits of proteins, mucins, lipids and calcium from soft contact lenses.

A further object of the present invention is the provision of a method for removing such deposits from the surface and sub-surface areas of soft contact lenses in an economical, convenient and efficient manner.

The foregoing objects and other general objects of the present invention are achieved by the provision of a contact lens cleaning preparation comprising an enzyme having proteolytic activity; a surfactant selected from the group consisting of nonionic compounds of formula:

$$HO-(CH_2-CH_2-O)_x-(\underset{\underset{CH_3}{|}}{CH}-CH_2-O)_y-(CH_2-CH_2-O)_x-H$$

in which y is a whole number from 10 to 50 and x is a whole number from 5 to 20, and anionic dissociating compounds of formula:

$$R-O-(CH_2-CH_2-O)_z-CH_2-COOH$$

in which z is a whole number from 1 to 25 and R is a $C_8$ to $C_{18}$ hydrocarbon chain; and optionally also a calcium chelating agent and urea.

DESCRIPTION OF THE PREFERRED EMBODIMENTS

This invention provides nontoxic, aqueous solutions for the efficient removal of proteinaceous material, mucins, lipids and calcium deposits from contact lenses. In a first embodiment of the invention, the solutions include a combination of an enzyme having proteolytic activity, and one or more nonionic or weakly anionic surfactants as the principal lens-cleaning ingredients. A second embodiment of the invention utilizes a combination of an enzyme having proteolytic activity, one or more nonionic or weakly anionic surfactants, and a calcium chelating agent as the principal lens cleaning ingredients. A third embodiment of the present invention utilizes urea as an additional lens cleaning ingredient in the above-described combinations.

The enzymes utilized in the present invention are characterized in that they do not affect the molecular structure of the polymeric hydrogel making up the lens. The preferred enzymes are pancreatin, a multienzyme complex having proteolytic, lipolytic and amylolytic activity, and papain, an enzyme having proteolytic activity. Pancreatin is a multienzyme complex derived from animal pancreata, preferably from porcine pancreata. Papain is an enzyme derived from the green fruit of Carica papaya. Further details concerning pancreatin and papain are set forth in *The Merck Index,* 10th Ed., pages 1005 and 1007 (1983), including a listing of publications relating to these enzymes; the contents of these publications are incorporated herein by reference. The above-described pancreatin and papain enzymes are commercially available. The amount of enzyme which should be used in the present invention is in the range of from about 0.01% to 5% (w/v), preferably from about 0.05% to 1%.

The nontoxic surfactants utilized in the lens-cleaning solutions of the present invention are selected from the group consisting of nonionic compounds of formula:

$$HO-(CH_2-CH_2-O)_x-(\underset{\underset{CH_3}{|}}{CH}-CH_2-O)_y-(CH_2-CH_2-O)_x-H \quad (I)$$

in which y is a whole number from 10 to 50, preferably 30 and x is a whole number from 5 to 20, preferably 10, and weakly anionic compounds of formula:

$$R-O-(CH_2-CH_2-O)_z-CH_2-COOH \quad (II)$$

in which z is a whole number from 1 to 25, preferably 10, 13 or 16 and R is a $C_8$ to $C_{18}$ hydrocarbon chain, preferably a $C_{12}$ hydrocarbon chain.

The above-described surfactants are commercially available. For example, the above-identified nonionic surfactants are available under the name "PLURIOL" from BASF, Ludwigshafen, West Germany. The physical properties and other characteristics of these nonionic surfactants are further described in technical information sheets available from BASF. The above-identified anionic surfactants are commercially available under the name "AKYPO (RLM)" from CHEM-Y, Emmerich, West Germany. The physical properties and other characteristics of these anionic surfactants are further described in European Patent Application No. 83201182.9, filed Aug. 10, 1983, and published as Publication No. 0 102 118 on Mar. 7, 1984. A preferred anionic surfactant of the above-described type is AKYPO RLM 100. A preferred nonionic surfactant of the above-described type is PLURIOL L 64. The amount of surfactant contained in the lens cleaning solutions of the present invention is in the range of from about 0.02% to 1% (w/v), preferably from about 0.2% to 0.6%.

The commercially available surfactants normally contain impurities which can be removed using conventional techniques such as, for example, molecular exclusion chromatography in the case of the nonionic surfactants and ion exchange chromatography in the case of the anionic surfactants.

The chelating agents utilized in the present invention must be capable of sequestering calcium in a manner such that calcium deposits are effectively removed from the lenses undergoing treatment. Such chelating agents are generally inorganic or organic acids, such as, polycarboxylic acids. Chelating agents of this type are described in *Special Publication No.* 17: "Stability Constants of Metal-Ion Complexes," The Chemical Society (London, 1964); the entire contents of this reference relating to the physical properties and other characteristics of these chelating agents are incorporated herein by reference. The preferred chelating agents are polycarboxylic acids, particularly citric acid and ethylenediaminetetraacetic acid (EDTA). A combination of citric acid and EDTA is especially preferred as the chelating agent component of the present solutions. The amount of chelating agent required in the lens cleaning solutions in order to perform the above-described function is from about 0.005% to 0.5% (w/v), preferably from about 0.05% to 0.2%. Since the chelating agent is included in the solutions primarily for its calcium removing function, this component is only required in the lens cleaning solutions of the present invention which are designed to remove calcium deposits.

Urea is also an optional ingredient in the lens cleaning solutions of the present invention. As mentioned again below, urea has been found to be effective in removing both surface and sub-surface deposits of lipids and proteins when utilized in relatively high concentrations, such as 10% w/v or greater. Conversely, it has also been found that urea is somewhat less effective in removing these deposits when utilized in relatively low concentrations. Accordingly, the optional inclusion of this compound in the present solutions will normally be determined by factors such as the severity of the lens deposits. If included, the amount of urea contained in the lens cleaning solutions is from about 0.02% to 1% (w/v), preferably from about 0.2% to 0.6%.

It has surprisingly been found that the enzymatic activity of pancreatin and papain is not significantly decreased or is only slightly decreased in the presence of the above-described combinations of surfactant, chelating agent and urea. More specifically, it has been shown that combinations of the above-described surfactants, chelating agents and urea do have a concentration dependent effect on papain and pancreatin activity; however, in most cases this effect only constitutes an insignificant decrease in enzyme activity. Examples 1–10 below illustrate this concentration dependent effect.

According to the present invention nontoxic, aqueous cleaning solutions containing a mixture of the above-described compounds are provided. This mixture may be included in the lens cleaning solutions of the present invention at concentrations of, for example, from about 0.03% to 7.5% (w/v), preferably from about 0.25% to 2.4% (w/v). The cleaning solutions may be formulated as isotonic, hypotonic or hypertonic solutions, and typically may also contain other conventional formulatory ingredients, such as, preservatives, viscosity enhancing agents and buffers.

It should be noted that the aforesaid description of the amounts of the various compounds utilized in the solutions of the present invention are expressed as percentage of material in solution (i.e., w/v %). The formulation may also be in the form of a tablet (for the enzyme) and a solution (for the surfactant, chelating agent and urea). The percentage composition of the enzyme in the tablet is such that when dissolved in a specified volume of the surfactant solution, the cleaning solution formed will have percentage composition values within the ranges set forth above.

The present invention also provides a method of cleaning contact lenses. This method comprises contacting the lenses with the lens cleaning solutions of the present invention. A preferred method of cleaning soft lenses according to the present invention is as follows. First, the lenses are placed in a suitable container with an amount of the above-described cleaning solution sufficient to cover the lenses. The lenses are then soaked at room temperature for a period of about 5 minutes to 24 hours, preferably 1 to 12 hours, or for shorter periods at elevated temperatures, e.g., 0.5 to 6 hours at 37° C.

It has surprisingly been found that the lens cleaning solutions of the present invention containing the above-described mixture of compounds are very effective in removing deposits comprising proteinaceous material, lipids, mucins and calcium from soft contact lenses. The enzyme component of the mixture is believed to act synergistically with the other ingredients of the mixture. This synergism is seen both with and without the inclusion of the optional components (i.e., chelating agent and urea) of the solutions. The lens cleaning preparations of the present invention have also been found to provide for improved removal of lipid and other deposits from hard, gas permeable contact lenses.

While applicant does not wish to be bound to any particular theory, it is believed that the urea and surfactant components of the above-described mixture alter the molecular conformation of the protein deposits located on and below the lens surface to form a less folded, amino acid polymer which is hydrolyzed by the enzyme component of the mixture. This alteration in molecular conformation enables the protein deposits located below the lens surface to migrate to the lens surface where they are hydrolyzed by the enzyme component of the mixture. The urea and surfactant components effect solubilization and removal of protein and lipid deposits, while the chelating agent removes calcium deposits. The non-enzyme components of the mixture also significantly reduce sorption of the used enzyme component to the lens surface, thereby preventing or minimizing immunological problems associated with contact between the human eye and enzymes. As used in this specification, the term "sorption" is intended to include both absorption and adsorption. Thus, the non-enzyme components of the above-described mixtures help to prevent association of enzymes with the surface of the lens based on principles of adsorption and association of enzymes with the lens matrix based on principles of absorption.

The following examples are presented to further illustrate the lens cleaning solution and method of the present invention, but should not be interpreted as limiting the scope of the invention in any way.

EXAMPLES 1-10

The enzymatic activity of pancreatin and papain was measured in the presence of different concentrations of the other ingredients contained in the solutions of the present invention. The mixtures utilized contained 10 mg/mL native human serum albumin as substrate, 2 mg/mL of the enzyme, 0.8 percent saline, 0.05 percent phosphate buffer (pH 7.2) and varying amounts of surfactant, urea, and chelating agents. The mixtures were incubated for two hours at 20° C. After incubation the mixtures were adjusted to 5 percent trichloroacetic acid and centrifuged at 9000×g for 10 minutes. The enzyme activity was analyzed by measuring the amino acids in the clear supernatants. The results obtained are set forth in Table 1 below. (NOTE: The composition of formulations A and B is set forth below following Table 1.)

TABLE 1

| Enzyme Activity Based on Hydrolysis of Human Serum Albumin (mg/ml) | | | |
|---|---|---|---|
| Example | Incubation Mixture | Pancreatin | Papain |
| | Enzyme in saline (Control) | 1.1 | 0.14 |
| 1 | Enzyme in Saline + Formulation A | 0.85 | 0.07 |
| 2 | Enzyme in saline + formulation A/2 | 0.9 | 0.08 |
| 3 | Enzyme in saline + formulation A/5 | 0.9 | 0.09 |
| 4 | Enzyme in saline + formulation A/10 | 0.95 | 0.12 |
| 5 | Enzyme in saline + formulation A/20 | 1.05 | 0.14 |
| 6 | Enzyme in saline + formulation B | 0.65 | 0.012 |
| 7 | Enzyme in saline + formulation B/2 | 0.72 | 0.036 |
| 8 | Enzyme in saline + formulation B/5 | 0.84 | 0.042 |
| 9 | Enzyme in saline + formulation B/10 | 0.91 | 0.051 |
| 10 | Enzyme in saline + formulation B/20 | 0.98 | 0.054 |

Formulation A consists of:

0.4% of a nonionic surfactant (PLURIOL L 64) of formula $$HO-(CH_2-CH_2-O)_{10}(\underset{\underset{CH_3}{|}}{CH}-CH_2-O)_{30}(CH_2-CH_2-O)_{10}H;$$

0.4% urea; and a combination of 0.1% citric acid and 0.1% ethylenediaminetetraacetic acid as the chelating agent.

Formulation B consists of:

the same urea and chelating agents as in Formulation A above, but includes an anionic surfactant (AKYPO RLM 100) of formula $$CH_3(CH_2)_{10}CH_2-O(CH_2-CH_2-O)_{10}CH_2-COOH$$

in place of the nonionic surfactant utilized in Formulation A. Formulations A/2, A/5, A/10, A/20, B/2, B/5, B/10 and B/20 represent the corresponding dilutions of Formulations A and B, respectively.

The foregoing results demonstrate the activity of the enzymes contained in the cleaning formulations of this invention.

EXAMPLE 11

Soft contact lenses (TRESOFT) having deposits of $^{125}$I-labeled lysozyme (12,000 dpm), $^{14}$C-acetylated mucin (7,000 dpm) and $^{45}$Ca-labeled phosphatidylglycerol-calcium salt (10,000 dpm) were soaked for one hour at room temperature in cleaning solutions (solutions I, II, and III) containing:

solution I: pancreatin (2 mg/mL) in saline solution II: formulation A (see Examples 1-10) in saline solution III: pancreatin (2 mg/mL) and formulation A in saline.

The lenses were then rinsed thoroughly with saline and the radioactivity remaining on the lenses was determined by liquid scintillation. The results obtained are set forth in Table 2 below.

TABLE 2

| Cleaning solution | Average dpm in lens sample | | |
|---|---|---|---|
| | $^{125}I$ | $^{14}C$ | $^{45}Ca$ |
| I | 2683 | 3241 | 7866 |
| II | 3492 | 2716 | 1460 |
| III | 254 | 1532 | 1189 |

The above results demonstrate that lens deposit removal is most effective with cleaning solution III, which solution is formulated in accordance with the present invention. The results also demonstrate the synergistic cleaning effect seen with the ingredients contained in cleaning solution III.

EXAMPLE 12

Soft contact lenses having radioactive deposits of the type described in Example 11 were soaked in the following cleaning solutions:

solution IV: papain (2 mg/ml) in saline solution V: formulation B/20 (see Examples 1–10) in saline solution VI: papain (2 mg/ml) and formulation B/20 in saline The conditions utilized were the same as those described in Example 11. The results obtained are set forth in Table 3 below.

TABLE 3

| Cleaning Solution | Average dpm in lens sample | | |
|---|---|---|---|
| | $^{125}I$ | $^{14}C$ | $^{45}Ca$ |
| IV | 5123 | 5001 | 8715 |
| V | 4917 | 3189 | 2396 |
| VI | 856 | 2857 | 2211 |

The above results demonstrate that lens deposit removal is most effective with cleaning solution VI, which solution is formulated in accordance with the present invention. The results also demonstrate the synergistic cleaning effect seen with the ingredients contained in cleaning solution VI.

EXAMPLES 13–18

Two hydrated soft contact lenses (TRESOFT) were soaked for two hours at room temperature in the following assay mixtures (solutions):

solution I: an aqueous solution containing 0.8% NaCl, 0.05% phosphate buffer (pH 7.2) and 2.5 mg/mL pancreatin solution II: identical to solution I, except for substitution of 2.5 mg/ml papain in place of pancreatin solution III: solution I+formulation A solution IV: solution I+formulation B solution V: solution II+formulation A solution VI: solution II+formulation B After completion of the soaking, the lenses were removed from the solutions and extensively rinsed with saline. The lenses were then put into glass vials containing 2 mL of 5.7N HCl. The vials were sealed and the lenses were then soaked for 20 hours at 110° C. to hydrolyze lens sorbed enzyme. After this hydrolysis of lens sorbed enzyme, HCl was evaporated and 0.1 mL 10% acetic acid was added to the vials. The hydrolyzed amino acids in the acetic acid were then spotted on HPTLC plates, separated, and then stained with ninhydrin, and measured quantitatively by HPTLC scanning. The data are presented in Table 4 below.

TABLE 4

| Example | Solution | Sorption of Enzyme (μg) on Two Lenses | |
|---|---|---|---|
| | | pancreatin | papain |
| 13 | I | 0.94 ± 0.1 | — |
| 14 | II | — | 0.87 ± 0.1 |
| 15 | III | 0.12 ± 0.03 | — |
| 16 | IV | 0.09 ± 0.03 | — |
| 17 | V | — | 0.14 ± 0.02 |
| 18 | VI | — | 0.13 ± 0.02 |

The above results demonstrate that the sorption of enzymes on soft contact lenses in the presence of solutions of the present invention containing formulations A or B were decreased to about one tenth of the sorption seen with solutions which were identical except for an absence of formulations A and B.

The invention has been described herein with reference to certain preferred embodiments. However, as obvious variations thereon will become apparent to those skilled in the art, the invention is not to be considered as limited thereto.

I claim:

1. An aqueous contact lens cleaning solution, comprising from about 0.01 to 5.0 weight/volume percent of an enzyme having proteolytic activity and from about 0.02 to 1.0 weight/volume percent of an anionic surfactant of formula:

$$R—O—(CH_2—CH_2—O)_z—CH_2—COOH \quad \text{(II)}$$

in which z is a whole number from 1 to 25 and R is a $C_8$ to $C_{18}$ hydrocarbon chain.

2. The contact lens cleaning solution of claim 1, wherein the enzyme is selected from the group consisting of pancreatin and papain.

3. The contact lens cleaning solution of claim 1, further comprising from about 0.005 to 0.5 weight/volume percent of a calcium chelating agent selected from the group consisting of citric acid, ethylenediaminetetraacetic acid and combinations thereof.

4. The contact lens cleaning solution of claim 1, further comprising from about 0.02 to 1.0 weight/volume percent urea.

5. The contact lens cleaning solution of claim 3, wherein R and z in the formula (II) are a $C_{12}$ hydrocarbon chain and 10, respectively.

6. A method of cleaning a contact lens to remove deposits of proteinaceous material, mucins, lipids or calcium present on the lens, which comprises applying the contact lens cleaning solution of claim 1 to the lens.

* * * * *